US005293704A

United States Patent [19]

Brown

[11] Patent Number: 5,293,704

[45] Date of Patent: Mar. 15, 1994

[54] COLLAPSIBLE CRAFTING FRAME WITH STORAGE COMPARTMENT BASE

[76] Inventor: Sandra L. Brown, 248 Outlook Dr., Pittsburgh, Pa. 15228

[21] Appl. No.: 975,004

[22] Filed: Nov. 12, 1992

[51] Int. Cl.[5] ..... D06C 3/08; D06C 3/10

[52] U.S. Cl. ..... 38/102.9; 38/102.91

[58] Field of Search ..... 38/102, 102.1, 102.3, 38/102.4, 102.6, 102.8, 102.9, 102.91, DIG. 1, DIG. 2, 135; 108/12, 14, 15, 33, 34; 248/441.1, 450, 452, 453, 454, 461, 150, 544

[56] References Cited

U.S. PATENT DOCUMENTS

| | | | |
|---|---|---|---|
| 701,197 | 5/1902 | Gernert et al. | 38/135 |
| 1,976,031 | 10/1934 | Lowenberg | 38/DIG. 2 X |
| 2,318,877 | 5/1943 | Meyer et al. | 38/102.6 |
| 3,237,778 | 3/1966 | Hoodis | 38/102 X |
| 3,922,804 | 12/1975 | Batey | 38/102.91 |
| 3,967,562 | 7/1976 | Anacker | 108/12 |
| 4,677,775 | 7/1987 | Riley | 38/102.8 X |
| 4,944,105 | 7/1990 | Schulle | 38/102 |

*Primary Examiner*—Clifford D. Crowder
*Assistant Examiner*—Ismael Izaguirre
*Attorney, Agent, or Firm*—Clifford A. Poff

[57] ABSTRACT

A portable crafting frame includes carding strips to releasable support fabric while stretched across a window opening to allow access to opposite sides of the cloth. Front and back pairs of legs are pivotally supported by notches in upstanding walls in a hollow interior of the crafting frame at the underside and facing toward a base where the legs snap in notches formed in walls. The crafting frame is restrained against forward and aft movement by abutment walls in the frames and base that engage the legs in an operative positions. The legs can be released from the base pivoted against the bottom of the crafting frame to allow storage of the crafting frame in the base.

19 Claims, 5 Drawing Sheets

COLLAPSIBLE CRAFTING FRAME WITH STORAGE COMPARTMENT BASE

BACKGROUND OF THE INVENTION

1. Field of the Invention

The present invention relates to improvements to a crafting apparatus of the type used to present a tautly stretched base sheet of cloth material for rug hooking and needle working and, more particularly, the invention relates to a transportable crafting apparatus embodying a construction and arrangement of parts to allow a compact storage arrangement between a crafting frame and a support base for transportation purposes and to establish a rigid, supported interconnection between the base and the crafting frame so as to enhance the usefulness of such apparatus for crafting operations.

2. Description of the Prior Art

The construction of textile crafts is a popular hobby. For many textile crafts, the use of a frame is indispensable to provide a stable work area necessary to hold the textile in place and thereby avoid annoying distractions to the hobbyist engaged in rug hooking and needlework operations.

Previously, the use of such a crafting frame involved the placing of the textile on a frame which was part of a stand that was a free standing floor supported structure. Such a frame included devices such as rollers to spread the textile worked upon tightly. The existing frame designs are generally heavy and bulky thereby prohibiting fast and easy removal from one location to another. In addition, such existing frames generally involved protruding tension control arms to hold such textiles taut.

Examples of frame structures used to support fabric during rug hooking and needlework operations can be found in U. S. Pat. No. 773,577 of Mallory; U.S. Pat. No. 2,832,171 of Batey; U.S. Pat. No. 4,922,804 of Batey; U.S. Pat. No. 4,275,515 of Hinson; U.S. Pat. No. 4,315,645 of Knox; U.S. Pat. No. 4,375,197 of Hinson; U.S. Pat. No. 4,417,409 of Bell; U.S. Pat. No. 4,658,521 of Thorpe; and U.S. Pat. No. 4,677,775 of Riley. In this body of prior art, U.S. Pat. Nos. 2,832,171; 4,315,645; and 4,922,804 disclose a construction of a crafting frame to stretch the cloth material after attachment by carding strips to the frame so as to tension the cloth material across a window like opening of the frame. The parts necessary to tension the cloth material in this manner unduly complicate and enlarge the size of the crafting frame structure to such an extent that there is precluded the opportunity for reducing the gross size of a crafting frame assembly to a size to allow storage in a compact form and for transporting from place to place. Compact storage is not only important with respect to transportation and use at diverse sites but also use at diverse times at the same general site, i.e., a craft area in a room.

The rug hooking frame as disclosed in U.S. Pat. No. 4,922,804 exemplifies the use of a rigid frame formed by legs extending to a floor engaging frame part. Such a frame assembly requires an inordinate amount of space and therefore present a storage problem.

Accordingly it is an object of the present invention to provide an improved crafting apparatus to overcome the shortcomings and disadvantages arising out of the construction of known crafting apparatus.

It is a further object of the present invention to provide a crafting frame construction that can be simply and easily transformed from a rigid lightweight frame assembly to a compact transportable assembly that not only protectively houses normally delicate fabric hooking strips but also eliminates the need for any loose pieces that might otherwise become lost.

It is still a further object of the present invention to provide a crafting frame apparatus changeable from a compact transportable arrangement to a form ready for use wherein a crafting frame is interconnected with a base structure by rigid legs so engaged in the assembly to impart reliable rigidity and ease of transformation to the assembly to retain the stability of a larger, heavier crafting frame assembly.

SUMMARY OF THE PRESENT INVENTION

According to one form of the present invention there is provided a transportable crafting apparatus including the combination of a base having a support surface opposite to a storage compartment, a crafting frame having a window opening defined by carrier bars including cloth holding means releasably engaging cloth while spanning the window opening for allowing crafting operations on the cloth from opposite sides thereof, leg means for establishing a spaced apart operative position and a storage position for the crafting frame, the leg means being arranged in the operative position to extend between the crafting frame and the base, and support means supporting the leg means for pivotal movement on one of the base and the crafting frame, the support means anchoring the leg means to the other of the base and the crafting frame, the support means constraining the crafting frame against lateral movement relative to the storage compartment of the base while spaced therefrom in said operative position, the crafting frame being arranged and protectively supported in the storage compartment when the leg means pivot to establish the storage position.

According to another aspect of the present invention there is provided a crafting apparatus including the combination of a crafting frame having a window opening defined by carrier bars including cloth holding means releasably engaging cloth while spanning the window opening for allowing crafting operations on the cloth from opposite sides thereof, a base having a load bearing support surface, leg means for establishing a operative position and a inoperative position for the crafting frame, the leg means being arranged in the operative position to extend between the crafting frame and the base, releasable support means carried by one of the base and the crafting frame; and anchor means carried by the other of the base and the crafting frame, the releasable support and the anchor means being cooperatively engaged with the base and the crafting frame for constraining the crafting frame against lateral movement relative to the base.

BRIEF DESCRIPTION OF THE DRAWINGS

These features and advantages of the present invention as well as others will be more fully understood when the following description is read in light of the accompanying drawings in which.

DETAILED EMBODIMENT OF THE PRESENT INVENTION

Figure 1:
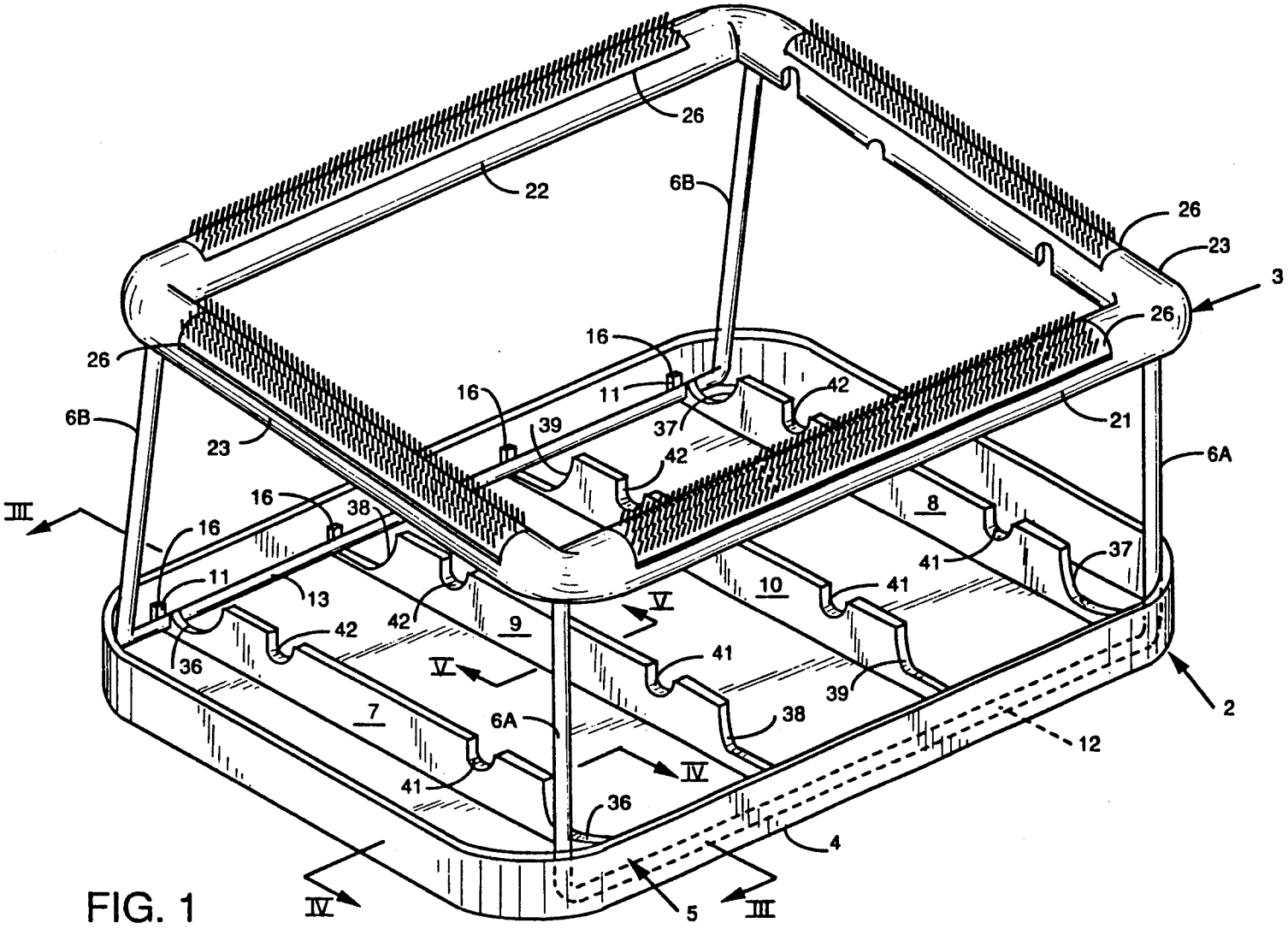
FIG. 1 is an isometric view of the transportable crafting apparatus of the present invention in an operative position.
Figure 2:
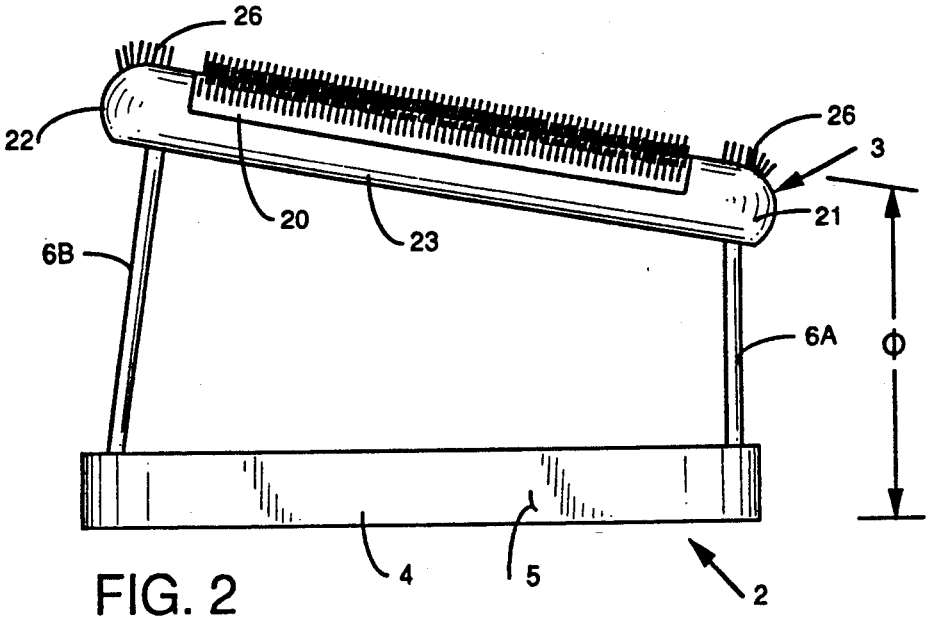
FIG. 2 is an end elevational view of the crafting apparatus shown in FIG. 1.
Figure 3:
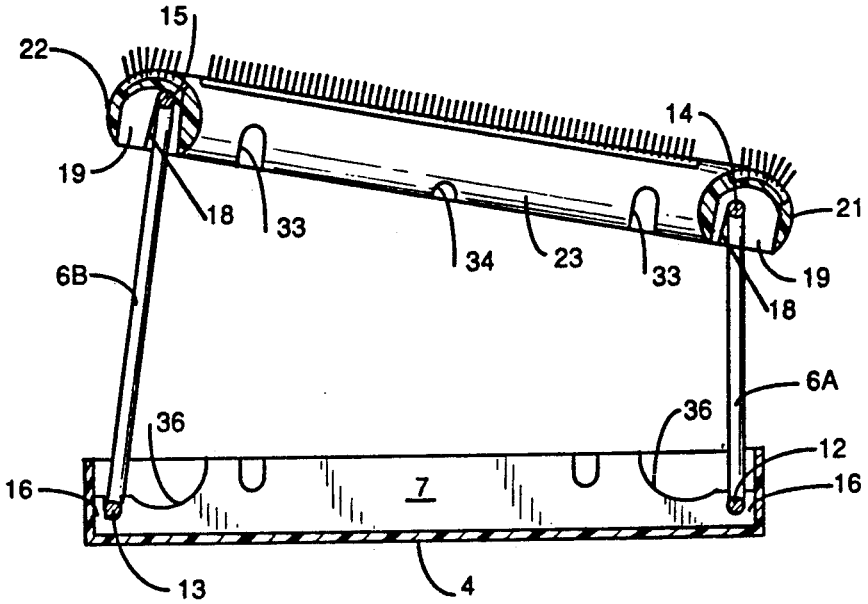
FIG. 3 is a sectional view taken along lines III—III of FIG. 1.
Figure 4:
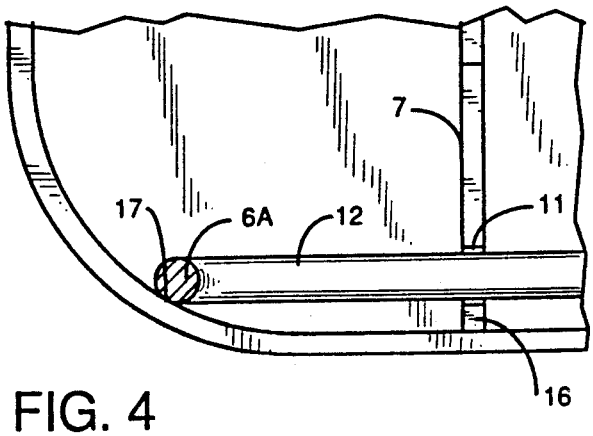
FIG. 4 is an enlarged partial plane view taken along lines IV—IV of FIG. 1.
Figure 5:
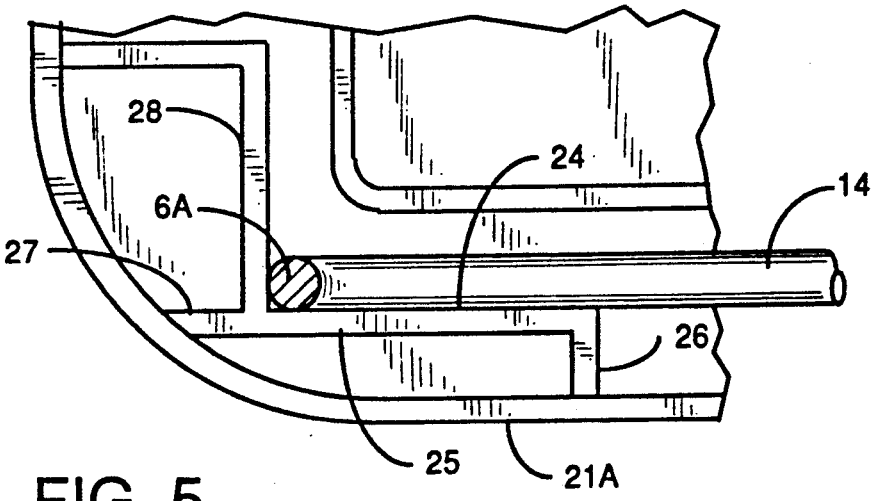
FIG. 5 is an enlarged partial plane view taken along lines V—V of FIG. 1.
Figure 6:
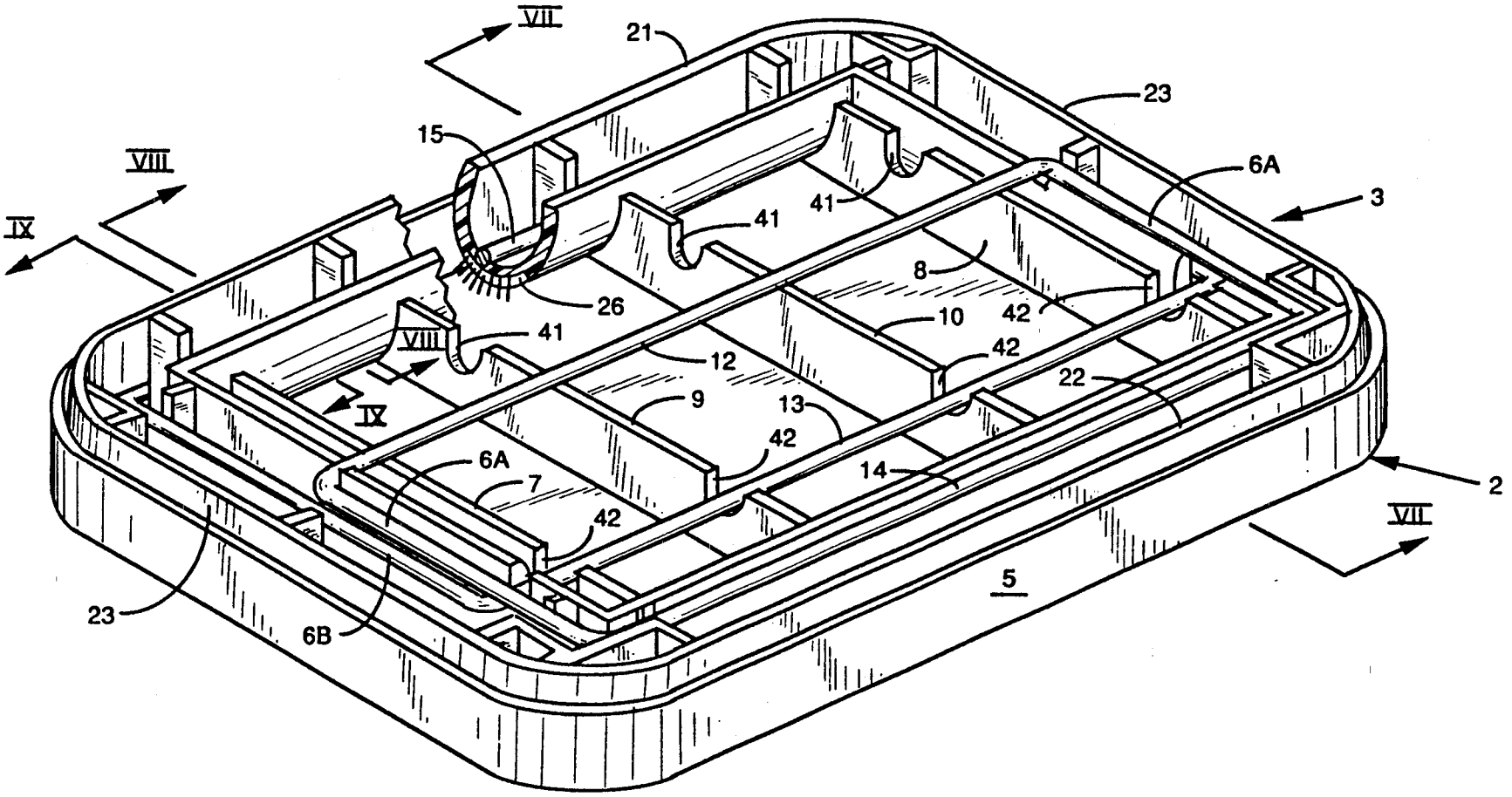
FIG. 6 is a perspective view of the crafting apparatus of FIG. 1 shown in a compact transportable state.
Figure 7:
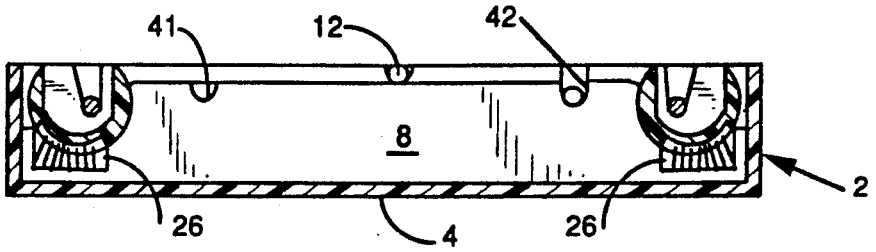
FIG. 7 is a sectional view taken along lines VII—VII of FIG. 6.

In FIGS. 1 and 6 there is illustrated the preferred embodiment of a transportable crafting apparatus embodying the features of the present invention. In FIG. 1 the crafting apparatus is shown in an operative position and includes a base 2 embodying a construction to receive and protectively house a crafting frame 3. As will be described in greater detail hereinafter the crafting frame and base are arranged in a spaced apart operative position that is established and maintained with great rigidity by an interconnection formed by a pair of front legs 6A and a pair of rear legs 6B. The front legs 6A have an operative length which is less than the operative length of the rear legs so as to angle the crafting frame 3 relative to a planar support face surface 4 of the base 2 at an angle $\phi$ between 10° and 15°, preferably about 12°. At this angled relation, and preferred spaced relation of about 8 inches between the base and frame, the crafting apparatus is well suited for support on a table at waist high level or on the craft person's legs in the seated position. The base 2 as shown in FIG. 114 3, includes an upstanding walls 5 that extends in an endless fashion about the entire periphery of the base outlining the rectangular configuration but with corner sections that are curved about a large radius. The height of the upstanding wall 5 is sufficient to form a cavity like storage compartment in the base wherein the crafting frame may be stored while encircled by the wall 5. Within the cavity of the base there is a parallel arrangement of upstanding outer support walls 7 and 8 that are spaced apart by a distance to accommodate an additional pair of parallel upstanding intermediate support walls 9 and 10. Outer walls 7 and 8 are identically constructed and intermediate walls 9 and 10 are identically constructed. Opposite ends of the outer walls 7 and 8 have notches 11 into which there is received spacer rod portions 12 and 13 extending between upstanding front legs 6A and rear legs 6B, respectively. Rod portions 12 and 13 are spaced from the front and rear wall portions of the upstanding wall 5 by spacer lugs 16. An important feature of the present invention, as shown in FIG. 4, resides in the relationship established by the positioning of the front legs 6A by the spacer rod 12 so that the legs engage the inwardly directed face of the curved portions to the upstanding wall 5 at sites identified by reference numeral 17 in a manner to preclude swinging of the legs 6A and 6B in a direction outwardly of the base while seated in the notches 11. The rear legs 6B are spaced apart by a distance which is less than the distance that the front legs are spaced apart so as to allow a more compact storage as will be described hereinafter.

The lengths of each of the front legs and the rear legs terminate at right angle bends at the upper ends thereof from where there extends terminal end portion 14 of the front legs and terminal end portion 15 of the rear legs. Leg end portion 14 and 15 are received in notches 18 formed in transverse walls 19 extending at spaced apart locations across a hollow interior of each of front and rear crafting frame walls 21 and 22, respectively. Frame wall 21 and 22 are interconnected by side crafting frame walls 23 forming part of the crafting frame 3. An important part of the present invention also resides in the abutting relationship established by the front legs 14 against face surfaces 24 of restraint walls 25. Surfaces 24 in each end of the front crafting frame walls 21 are spaced from outer boundary walls 21A of frame wall 21 by a spacer wall section 26 and supported by wall extension 27. Boundary walls 28 are beyond the boundaries of the distance between the legs 14. The contacting relationship between legs 14 and the outwardly directed faces 24 form upstanding abutment walls that engage the legs and preclude swinging of the frame in a direction toward the rear of the crafting assembly. The abuttable relation between legs 6A and site 17 as well as the relation between legs 6A and the outwardly directed faces 24 establishes a rigid operative position of the crafting frame with respect to the base with stability and prevents all unwanted free movement by the connections formed by legs between the crafting frame and the base.

The crafting frame 3 is further characterized by a preferred configuration to the walls 21, 22 and 23 each have circular ring sector cross-sectional configuration presenting convexly curved outer surfaces to which there is adhered lengths of carding strips 26 by suitable adhesive material. The carding strips, per se well known in the art, have a base of flexible fabric material used to support an array of projecting tangs which are of a small diameter so as to easily penetrate spaces formed by weft and warp threads of fabric sheet. A fabric sheet can be attached to the carding strips.

Figure 8:
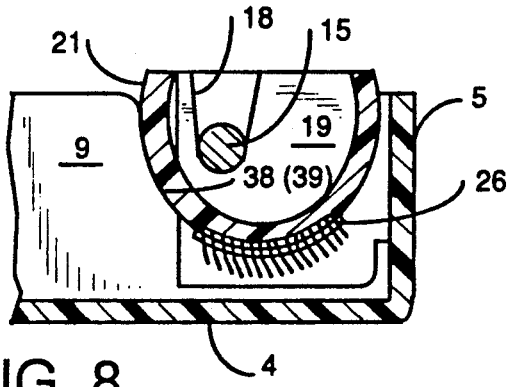
FIG. 8 is an enlarged partial sectional view taken along lines VIII—VIII of FIG. 6.
Figure 9:
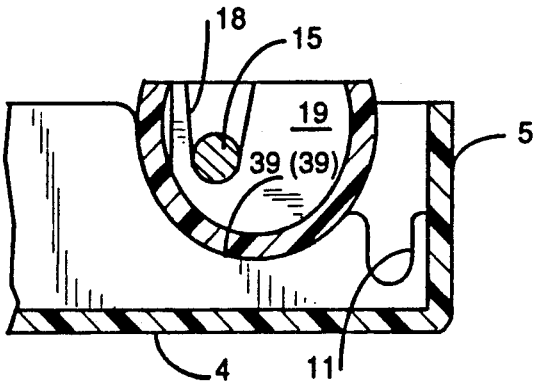
FIG. 9 is an enlarged partial sectional view taken along lines IX—IX of FIG. 6.

As can be seen the circular ring sector cross-sectional configuration of frame walls provide a convexly shaped outer surface of which has a recessed support site for receiving and supporting the carding strips. The crafting frame walls have hollow interiors wherein traverse walls 19 are formed with notches 18 having converging side walls extending to an angularly shaped area for pivotally supporting the terminal end portions 14 and 15 of the support legs. The side walls 23 of the crafting frame are each provided with notches 33 and 34 into which there is received spacer rod portions 12 and 13, respectively, to allow storage of the legs by pivotal movement in notches 18 from the operative position of parts showing in FIG. 1 to an inoperative, stored position shown in FIG. 6. To protectively house and support the crafting frame 3, the walls 7, 8, 9 and 10 each include oppositely directed cradle support surfaces 36, 37, 38 and 39, respectively. As shown in FIG. 9, the cradle support surfaces 36 and 37 are slightly less than hemispherical and oriented, as shown in FIG. 1, in generally opposing directions to impart positive lateral support for the crafting frame in the stored position wherein the frame is inverted and moved in nested relation within the storage area of the base. The cradle support surfaces 38 and 39 of walls 9 and 10 are spaced apart at a distance which is sufficient to preclude contact with the carding strips on the front and rear walls of the crafting frame. As shown in FIG. 8, the cradle support surfaces 37 and 38 have a concave configuration extending about an arch of approximately 45° so situated to engage a correspondingly convex surface of the crafting frame which is adjacent to but exclusive of the site where the carding strips are attached for support by the front and rear frame walls 21 and 22. As can be seen from FIG. 8 support surfaces 38 of wall 9, as well as surfaces 39 of wall 10 terminate at a storage pocket formed by the upstanding boundary walls 5. The cradle support surfaces 38 and 39 are dimensioned to remain always out of contact with the carding strips. In this way the carding strips particularly the tangs thereof are protected by the position of the crafting frame directed toward the floor wall of the base. To further accommodate and enhance the storage of the crafting frame in the base, the walls 7, 8, 9 and 10 are each provided with aligned notches 41 and 42. The rod portion 13 of the legs can be stored in a "flat" configuration of the base by nesting notches 41 or 42 dependent upon the orientation of the crafting frame in the base.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A transportable crafting apparatus including the combination of:

a base having a support surface opposite to a storage compartment;

a crafting frame having a window opening defined by carrier bars including cloth holding carding strips releasably engaging the cloth spanning said window opening for allowing crafting operations on the cloth from opposite sides thereof;

leg means for establishing a spaced apart operative position and a storage position for the crafting frame, the leg means in the operative position extending between the crafting frame and said base; and support means supporting said leg means for pivotal movement on one of said base and said crafting frame, said support means constraining said leg means to the other of said base and said crafting frame, said support means constraining said crafting frame against lateral movement relative to said storage compartment of the base while spaced therefrom in said operative position, said storage compartment of the base including means to prevent contact with said carding strips when said crafting frame is protectively supported in said storage compartment with said leg means in said storage position.

2. The transportable crafting apparatus according to claim 1 wherein said base includes a wall connected to the outer perimeters of a floor wall to protectively encircle said crafting frame in said storage position.

3. The transportable crafting apparatus according to claim 1 wherein said support means include an upstanding wall having a notch for pivotally supporting said leg means.

4. The transportable crafting apparatus according to claim 3 wherein said support means includes upstanding abutment walls for engaging with said legs to form restraints against pivotal movement thereof in said operative position.

5. The transportable crafting apparatus according to claim 1 wherein said support means includes upstanding walls on said base having cradle surfaces for supporting said crafting frame in said storage position.

6. The transportable crafting apparatus according to claim 1 wherein said carding strips bore a base strip carrying projecting tangs.

7. The transportable crafting apparatus according to claim 1 wherein the support surface of said base includes a planar support face surface.

8. The transportable crafting apparatus according to claim 1 wherein said support means includes abutment walls in each of said base means and said crafting frame for engaging with said leg means.

9. A crafting apparatus including the combination of:

a crafting frame having a window opening defined by carrier bars including cloth holding means releasably engaging the cloth spanning said window opening sides thereof;

a base having a load bearing support surface;

leg means for establishing an operative position and an inoperative position for the crafting frame, the leg means in the operative position extending between said crafting frame and said base;

releasable support means carried by one of said base and said crafting frame; and anchor means carried by the other of said base and said crafting frame, said releasable support and said anchor means being cooperatively abuttable with said leg means when extending between said base and said crafting frame for constraining the crafting frame against movement in any direction relative to said base.

10. The crafting apparatus according to claim 9 further including means carried by one of said crafting frame and said base for pivotally supporting said leg means to move between said operative position and said inoperative position.

11. The crafting apparatus according to claim 9 wherein said support means include an upstanding wall having a notch for pivotally supporting said leg means.

12. The crafting apparatus according to claim 9 wherein said support means includes upstanding abutment walls for engagement with said legs to form restraints against pivotal movement thereof in said operative position.

13. The crafting apparatus according to claim 9 wherein said cloth holding means includes carding strips having a base strip carrying projecting tangs.

14. The crafting apparatus according to claim 9 wherein said support means includes abutment walls in each of said base means and said crafting frame for engaging with said leg means.

15. The crafting apparatus according to claim 9 wherein the carrier bars of said crafting frame each have a circular ring sector cross-sectional configuration with a hollow interior having therein transverse walls with notches forming pivotal support sites for said leg means.

16. The crafting apparatus according to claim 15 wherein said anchor means include upstanding abutment walls in the hollow interior for engaging said legs.

17. The crafting apparatus according to claim 15 wherein said anchor means further includes upstanding wall means in said crafting frame for abutting contact with said leg means.

18. The crafting apparatus according to claim 9 wherein said releasable support means include notches formed in upstanding walls in said base for releasably engaging said leg means.

19. The crafting apparatus according to claim 17 wherein said anchor means includes an upstanding wall extending about an outer perimeter of said base for abutting contact with said leg means.

* * * * *